US007235513B2

(12) United States Patent
Isaac et al.

(10) Patent No.: US 7,235,513 B2
(45) Date of Patent: Jun. 26, 2007

(54) THERMAL DONOR

(75) Inventors: Walter H. Isaac, Penfield, NY (US); Christine J. Landry-Coltrain, Fairport, NY (US); David M. Teegarden, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 11/159,892

(22) Filed: Jun. 23, 2005

(65) Prior Publication Data

US 2006/0293186 A1 Dec. 28, 2006

(51) Int. Cl.
*B41M 5/035* (2006.01)
*B41M 5/50* (2006.01)

(52) U.S. Cl. ..... 503/227

(58) Field of Classification Search ..... 503/227
See application file for complete search history.

(56) References Cited

U.S. PATENT DOCUMENTS 5,360,781 A * 11/1994 Leenders et al. ..... 503/227
5,547,809 A * 8/1996 Defieuw et al. ..... 430/200
5,750,465 A 5/1998 Lum et al.
6,291,396 B1 9/2001 Bodem et al.

FOREIGN PATENT DOCUMENTS

JP 62-094382 4/1987

* cited by examiner

*Primary Examiner*—Bruce H. Hess
(74) *Attorney, Agent, or Firm*—Kathleen Neuner Manne; Lynne M. Blank

(57) ABSTRACT

A dye-donor element, a method of printing using the dye-donor element, and a print assembly including the dye-donor element are described, wherein the dye-donor layer of the dye-donor element includes a binder including an hydroxy-alkanoic acid polyester and one or more co-binder, wherein the co-binder is not polyester.

9 Claims, No Drawings

THERMAL DONOR

FIELD OF THE INVENTION

A thermal dye-donor element including a dye-donor layer having a dye and a binder including a mixture of an hydroxyalkanoic acid polyester and one or more co-binder, wherein the co-binder is not polyester, is disclosed.

BACKGROUND OF THE INVENTION

Thermal transfer systems have been developed to obtain prints from pictures that have been generated electronically, for example, from a color video camera or digital camera. An electronic picture can be subjected to color separation by color filters. The respective color-separated images can be converted into electrical signals. These signals can be operated on to produce electrical signals corresponding to various colors, for example, black, cyan, magenta, or yellow. These signals can be transmitted to a thermal printer. To obtain a print, a colored dye-donor layer, for example, black, cyan, magenta, or yellow, of a dye-donor element can be placed face-to-face with a dye image-receiving layer of a receiver element to form a print assembly, which can be inserted between a thermal print head and a platen roller. A thermal print head can be used to apply heat from the back of the dye-donor element. The thermal print head can be heated up sequentially in response to the various color signals. The process can be repeated as needed to print all colors, and a laminate or protective layer, as desired. A color hard copy corresponding to the original picture can be obtained. Further details of this process and an apparatus for carrying it out are described in U.S. Pat. No. 4,621,271 to Brownstein.

Thermal transfer works by transmitting heat through the dye-donor element from the back-side to the dye-donor layer. When the dyes in the dye-donor layer are heated sufficiently, they sublime or diffuse, transferring to the adjacent dye-receiving layer of the receiver element. The density of the dye forming the image on the receiver can be affected by the amount of dye transferred, which in turn is affected by the amount of dye in the dye-donor layer, the heat the dye-donor layer attains, and the length of time for which the heat is maintained at any given spot on the dye-donor element.

At high printing speeds, considered to be 2.0 ms/line or less, the print head undergoes heat on/off cycles very rapidly. This generated heat must be driven through the dye-donor element very rapidly to effect the dye transfer from the dye-donor layer to the receiver. Each layer in the dye-donor element can act as an insulator, slowing down the heat transfer through the layers of the dye-donor element to the receiver. Because of the short heat application time, any reduction in heat transfer efficiency results in a lower effective temperature in the dye-donor layer during printing, which can result in a lower transferred dye density. It is known to overcome the low print density associated with shorter line times by increasing the print head voltage, increasing the relative amount of dye in the dye-donor layer, or a combination thereof. Applying higher print head voltages can decrease the lifetime of the thermal print head, and requires a higher power supply, both of which increase cost. Increasing the relative amount of dye in the dye-donor layer increases costs, as well as increasing the chance of unwanted dye transfer, such as during storage of a dye-donor element.

Another problem exists with many of the dye-donor elements and receiver elements used in thermal dye transfer systems. At the high temperatures used for thermal dye transfer, many polymers used in these elements can soften and adhere to each other, resulting in sticking and tearing of the dye-donor and receiver elements upon separation from one another after printing. Areas of the dye-donor layer other than where dye was image-wise transferred to the receiver can adhere to the dye image-receiving layer, causing print defects ranging from microscopic spots to sticking of the entire dye-donor layer on the receiver. This is aggravated when higher printing voltages, resulting in higher temperatures, are used in high speed printing. Another problem with high speed printing is that the more rapid physical motion of the dye-donor/receiver assembly results in higher peel rates between the dye-donor element and the receiver element as they are separated after printing, which can aggravate sticking of the dye-donor and receiver elements.

Various binders and plasticizers have been used in thermal dye-donor elements. JP 62-094382A discloses a mixture of a polycaprolactone and a polyester for use as a binder in a thermal dye-donor. U.S. Pat. No. 5,750,465 also discloses use of a specific polyester as a plasticizer for use in a thermal dye-donor.

U.S. Pat. No. 4,732,815 describes a thermal dye transfer system wherein polycaprolactone is a resin in a filling layer, which is coated over a hot melt ink layer. It is desired that the hot melt ink layer have a very low melt viscosity so that complete transfer of the entire hot melt ink layer (binder and ink) to the dye receiving layer will occur. The filling layer is also completely transferred onto the dye receiving layer surface. Such a system, commonly referred to as a hot wax transfer system, mass transfers the dye-donor layer onto the dye receiving layer by the heat of the thermal print head. This does not produce a gradation of densities and is not appropriate for dye diffusion or sublimation thermal dye transfer systems, where it is desired that only the dye transfer and diffuse into the dye receiving layer to obtain a continuous tone (gradation of densities) image.

There is a need in the art for a means of providing one or more of the following advantages using a dye-donor element: 1) maintaining or increasing print density, such as by increased dye transfer efficiency; 2) maintaining or reducing power to the print head; 3) reducing or eliminating dye-donor/receiver sticking; and 4) increasing print speed.

SUMMARY OF THE INVENTION

A thermal dye-donor element, a print assembly including the element, and a method of printing are described, wherein the dye-donor element includes a dye-donor layer and a substrate, wherein the dye-donor layer includes a dye and a binder, wherein the binder includes an hydroxyalkanoic acid polyester having a Tg less than 25° C. and a co-binder that is not a polyester, wherein the hydroxyalkanoic acid polyester has the following formula:

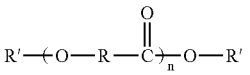

wherein each R is independently selected from an alkyl or alkylene oxide group of from 1 to 12 carbon atoms, wherein each alkyl group can be linear, branched, or cyclic; each R' is independently selected from a hydrogen atom or an alkyl group or substituted alkyl group of from 1 to 24 carbon atoms; wherein R or R' can be substituted; and wherein n is an integer selected so that the hydroxyalkanoic acid polyester has a polystyrene equivalent weight average molecular weight of from about 10,000 to about 500,000.

ADVANTAGES

The use of a binder including hydroxyalkanoic acid polyester and a co-binder in a dye-donor element enables one or more of fast printing while maintaining or increasing print density, maintaining or reducing power to the print head, reducing or eliminating dye-donor/receiver sticking, maintaining good dye-donor layer keeping properties, increasing transfer efficiency of the dye, and maintaining or increasing print density.

DETAILED DESCRIPTION OF THE INVENTION

A dye-donor element having a binder including an hydroxyalkanoic acid polyester and one or more co-binder, wherein the co-binder is not polyester, a printing assembly including the dye-donor element and a receiver element, and a method of printing using the dye-donor element are presented.

As used herein, "sticking" refers to adherence of a dye-donor element to a receiver element. Sticking can be detected by resultant defects in the dye-donor element or receiver element. For example, sticking can cause a removal of dye from the dye-donor element, appearing as a clear spot on the dye-donor element, or an over-abundance of dye on the receiver element. Sticking also can cause an uneven or spotty appearance on the dye-donor element. "Gross sticking" is when the dye-donor layer of the dye-donor element is pulled off of a support layer and sticks to the receiver element. This can appear as uneven and randomized spots across the dye-donor element and receiver element. "Microsticking" results in an undesirable image where a small area of the dye-donor element and receiver element stick together. Microsticking can be observed with a magnifying glass or microscope.

"Defect-free" or "defect-free image" as used herein refer to a printed image having no indication of dye-donor/receiver sticking as defined herein, and having no areas of dye-dropout in the image, wherein dye-dropout is defined as the absence of transfer of dye to the receiver element, or insufficient transfer of the dye to the receiver element, on a pixel by pixel basis.

"Number of steps with sticking" as used herein means the number of squares in a printed image of a density step tablet that had defects as defined above due to dye-donor/receiver sticking. The density step tablet image, having rectangular image fields of decreasing image density from $D_{max}$ to $D_{min}$, can be printed with a print assembly as described herein. As used herein, a "print" refers to formation of an image on a receiver element using at least one dye patch on a dye-donor element. As used herein, $D_{max}$ refers to the highest Status A reflection density that can be obtained using the print assembly under the specified print conditions, and $D_{min}$ refers to the density obtained when no dye is transferred to the receiver.

The dye-donor element can include a dye-donor layer. The dye-donor layer can include one or more colored areas (patches) containing one or more dye suitable for thermal printing. As used herein, a "dye" can be one or more dye, pigment, colorant, or a combination thereof. "Thermal printing" refers to sublimation and diffusion printing processes, for example, resistive head and laser thermal printing. During thermal printing, at least a portion of at least one colored area of the dye-donor layer of the dye-donor element can be imagewise or patch transferred to the receiver element, forming a colored image on the receiver element. The dye-donor layer can include one or more colored areas, a laminate area (patch) having no dye, or a combination thereof. The laminate area can follow one or more colored areas. During thermal printing, the entire laminate area can be transferred to the receiver element. The dye-donor layer can include one or more colored areas and one or more laminate areas. For example, the dye-donor layer can include three color patches, for example, yellow, magenta, and cyan, and a clear laminate patch, for forming a full color image with a protective laminate layer on a receiver element.

Any dye transferable by heat can be used in the dye-donor layer of the dye-donor element. The dye can be selected by taking into consideration hue, lightfastness, and solubility of the dye in the dye-donor layer binder and the dye image receiving layer binder. Examples of suitable dyes can include, but are not limited to, diarylmethane dyes; triarylmethane dyes; thiazole dyes, such as 5-arylisothiazole azo dyes; methine dyes such as merocyanine dyes, for example, aminopyrazolone merocyanine dyes; azomethine dyes such as indoaniline, acetophenoneazomethine, pyrazoloazomethine, imidazoleazomethine, imidazoazomethine, pyridoneazomethine, and tricyanopropene azomethine dyes; xanthene dyes; oxazine dyes; cyanomethylene dyes such as dicyanostyrene and tricyanostyrene dyes; thiazine dyes; azine dyes; acridine dyes; azo dyes such as benzeneazo, pyridoneazo, thiopheneazo, isothiazoleazo, pyrroleazo, pyraleazo, imidazoleazo, thiadiazoleazo, triazoleazo, and disazo dyes; arylidene dyes such as alpha-cyano arylidene pyrazolone and aminopyrazolone arylidene dyes; spiropyran dyes; indolinospiropyran dyes; fluoran dyes; rhodaminelactam dyes; naphthoquinone dyes, such as 2-carbamoyl-4-[N-(p-substituted aminoaryl)imino]-1,4-naphthaquinone; anthraquinone dyes; and quinophthalone dyes. Specific examples of dyes usable herein can include:

- C.I. (color index) Disperse Yellow 51, 3, 54, 79, 60, 23, 7, and 141;
- C.I. Disperse Blue 24, 56, 14, 301, 334, 165, 19, 72, 87, 287, 154, 26, and 354;
- C.I. Disperse Red 135, 146, 59, 1, 73, 60, and 167;
- C.I. Disperse Orange 149;
- C.I. Disperse Violet 4, 13, 26, 36, 56, and 31;
- C.I. Disperse Yellow 56, 14, 16, 29, 201 and 231;
- C.I. Solvent Blue 70, 35, 63, 36, 50, 49, 111, 105, 97, and 11;
- C.I. Solvent Red 135, 81, 18, 25, 19, 23, 24, 143, 146, and 182;
- C.I. Solvent Violet 13;
- C.I. Solvent Black 3;
- C.I. Solvent Yellow 93; and
- C.I. Solvent Green 3.

Further examples of sublimable or diffusible dyes that can be used include anthraquinone dyes, such as Sumikalon Violet RS™ (product of Sumitomo Chemical Co., Ltd.), Dianix Fast Violet 3R-FS™ (product of Mitsubishi Chemical Corporation.), and Kayalon Polyol Brilliant Blue N-BGM™ and KST Black 146™ (products of Nippon Kayaku Co., Ltd.); azo dyes such as Kayalon Polyol Brilliant Blue BM™, Kayalon Polyol Dark Blue 2BM™, and KST Black KR™ (products of Nippon Kayaku Co., Ltd.), Sumickaron Diazo Black 5G™ (product of Sumitomo Chemical Co., Ltd.), and Miktazol Black 5 GH™ (product of Mitsui Toatsu Chemicals, Inc.); direct dyes such as Direct Dark Green B™ (product of Mitsubishi Chemical Corporation) and Direct Brown M™ and Direct Fast Black D™ (products of Nippon Kayaku Co. Ltd.); acid dyes such as Kayanol Milling Cyanine 5R™ (product of Nippon Kayaku Co. Ltd.); and basic dyes such as Sumicacryl Blue 6G™ (product of Sumitomo Chemical Co., Ltd.), and Aizen Malachite Green™ (product of Hodogaya Chemical Co., Ltd.); magenta dyes of the structures

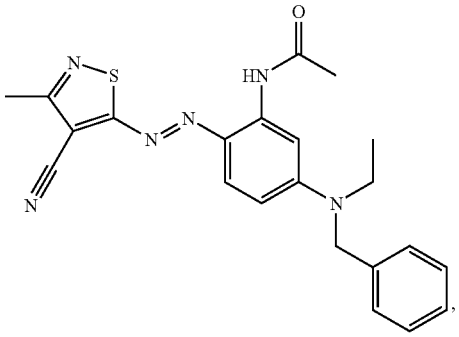

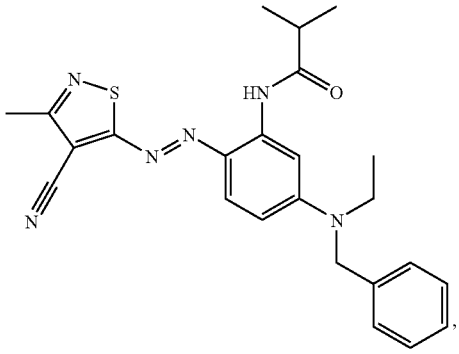

and

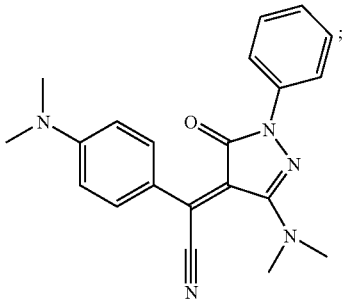

cyan dyes of the structures

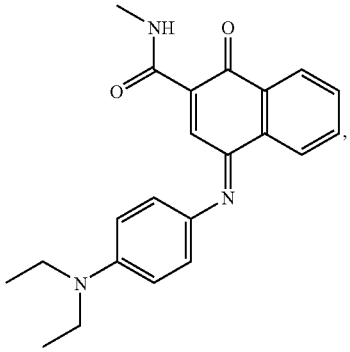

-continued

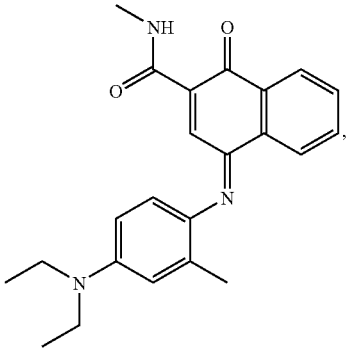

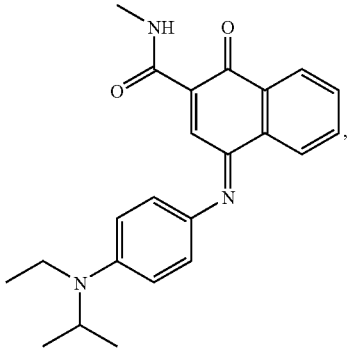

and

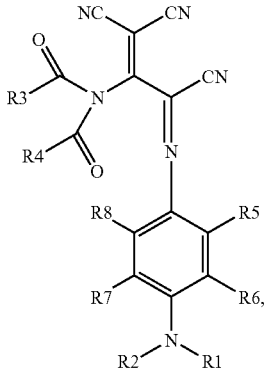

where R1 and R2 each independently represents an alkyl group, a cycloalkyl group, an aryl group, a heterocyclic group, or R1 and R2 together represent the necessary atoms to close a heterocyclic ring, or R1 and/or R2 together with R6 and/or R7 represent the necessary atoms to close a heterocyclic ring fused on the benzene ring; R3 and R4 each independently represents an alkyl group, or an alkoxy group; R5, R6, R7 and R8 each independently represents hydrogen, an alkyl group, a cycloalkyl group, an aryl group, an alkoxy group, an aryloxy group, a carbonamido group, a sulfamido group, hydroxy, halogen, $NHSO_2R_9$, $NHCOR_9$, $OSO_2R_9$, or $OCOR_9$, or R5 and R6 together and/or R7 and R8 together represent the necessary atoms to close one or more heterocyclic ring fused on the benzene ring, or R6 and/or R7 together with R1 and/or R2 represent the necessary atoms to close a heterocyclic ring fused on the benzene ring; and R9 represents an alkyl group, a cycloalkyl group, an aryl group and a heterocyclic group; and yellow dyes of the structures

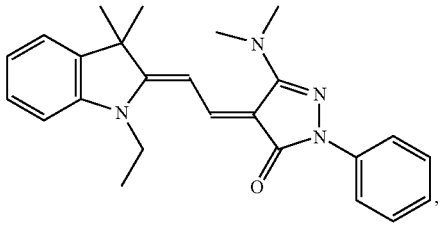

, and

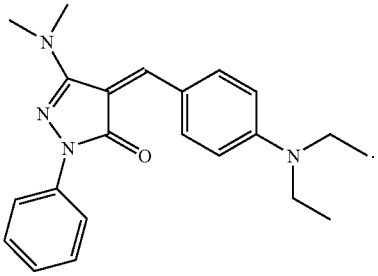

.

Further examples of useful dyes can be found in U.S. Pat. Nos. 4,541,830; 4,824,437; 4,910,187; 4,923,846; 5,026,677; 5,101,035; 5,142,089; 5,476,943; 5,804,531; and 6,265,345, and U.S. Patent Application Publication No. US 20030181331. Suitable cyan dyes can include Kayaset Blue 714 (Solvent Blue 63, manufactured by Nippon Kayaku Co., Ltd.), Phorone Brilliant Blue S-R (Disperse Blue 354, manufactured by Sandoz K. K.), and Waxoline AP-FW (Solvent Blue 36, manufactured by ICI). Suitable magenta dyes can include MS Red G (Disperse Red 60, manufactured by Mitsui Toatsu Chemicals, Inc.), and Macrolex Violet R (Disperse Violet 26, manufactured by Bayer). Suitable yellow dyes can include Phorone Brilliant Yellow S-6 GL (Disperse Yellow 231, manufactured by Sandoz K. K.) and Macrolex Yellow 6G (Disperse Yellow 201, manufactured by Bayer). The dyes can be employed singly or in combination to obtain a monochrome dye-donor layer or a black dye-donor layer. The dyes can be used in an amount of from 0.05 $gm^{-2}$ to 1 $gm^{-2}$ of coverage. According to various embodiments, the dyes can be hydrophobic.

Each dye-donor layer color patch can range from 20 wt. % to 90 wt. % dye, relative to the total dry weight of all components in the layer. A high amount of dye is desirable for increased efficiency, but higher amounts of dye can lead to increased occurrences of dye-donor/receiver sticking. Depending on the efficiency of dye transfer of a dye-donor layer, a lower amount of dye can be used to achieve the same efficiency as in a different colored dye-donor layer or patch. The dye percent is ideally chosen in view of the specific dye-donor and receiver combination. Varying the amount of dye in the dye-donor layer can aid in matching the efficiency between different dye patches, for example, a cyan, magenta, and yellow patch. For example, yellow and/or magenta patch dye amounts can be between 20 wt. % and 75 wt. % dye relative to the total dry weight of all components in the layer, for example, between 30 wt. % and 50 wt. %. A cyan patch dye amount can be between 40 wt. % and 90 wt. % dye relative to the total dry weight of all components in the layer, for example, between 55 wt. % and 75 wt. %.

To form a dye-donor layer, one or more dyes can be dispersed in a polymeric binder including an hydroxyalkanoic acid polyester and one or more co-binders, wherein the co-binder is not polyester. The binder can be used in an amount of from 0.05 $gm^{-2}$ to 5 $gm^{-2}$, for example, from 0.1 $gm^{-2}$ to 1.5 $gm^{-2}$. The term "hydroxyalkanoic acid polyester" refers to a polyester that is prepared from the self-polycondensation of hydroxycarboxylic acids. A suitable hydroxyalkanoic acid polyester can have the following formula:

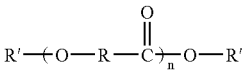

wherein each R is independently selected from an alkyl or alkylene oxide group of from 1 to 12 carbon atoms, wherein each alkyl group can be linear, branched, or cyclic; each R' is independently selected from a hydrogen atom or an alkyl group or substituted alkyl group of from 1 to 24 carbon atoms; wherein each R and R' independently can contain one or more substituent groups, for example, alkyl, cycloalkyl, phenyl, hydroxyl, alkoxyl, or halogen such as fluorine, chlorine, or bromine; and n is an integer selected so that the hydroxyalkanoic acid polyester has a polystyrene equivalent weight average molecular weight of from about 10,000 to about 500,000. The hydroxyalkanoic acid polyester can be a homopolymer or a copolymer.

Examples of suitable hydroxyalkanoic acid polyesters useful in the invention include polylactones and polylactides. Specific examples include, but are not limited to, the following: polyglycolide, polylactide also known as poly(lactic acid), polydimethylglycolide, poly(3-hydroxypropanoic acid) also known as poly(β-propriolactone), poly(3-hydroxybutanoic acid), poly(4-hydroxybutanoic acid) also known as poly(γ-butyrolactone), poly(2,2-dimethyl-3-hydroxypropanoic acid) also known as polypivalolactone, poly(5-hydroxypentanoic acid), and poly(6-hydroxyhexanoic acid) also known as poly(ϵ-caprolactone) or polycaprolactone.

According to certain embodiments, the hydroxyalkanoic acid polyester has a polystyrene equivalent weight average molecular weight of from about 10,000 to about 500,000, for example, 14,000 to 200,000, as determined by size-exclusion chromatography using standard polystyrene samples for calibration. The hydroxyalkanoic acid polyester has a Tg less than about 25° C.

Suitable co-binder polymers useful for the invention can include any binders known for use in thermal dye-donor layers, except polyesters. Examples of suitable co-binders can include, but are not limited to, cellulose derivatives, polyvinylacetals, styrene-containing polymers, and acrylate-containing polymers. For example, suitable cellulose derivatives can include, but are not limited to, cellulose ester, cellulose ether, and cellulose nitrate polymers, for example, acetate hydrogen phthalate, cellulose acetate, cellulose acetate propionate, cellulose acetate butyrate, cellulose triacetate, cellulose nitrate, ethylcellulose, methylcellulose, and hydroxyalkyl celluloses such as hydroxypropyl cellulose, methylhydroxypropyl cellulose, and hydroxypropylmethyl cellulose. Suitable styrenic and acrylic co-binder polymers can include, but are not limited to, for example, poly(styrene-co-acrylonitrile), polystyrene, poly(methyl acrylate), poly(methyl methacrylate), poly(phenyl methacrylate), poly(butyl methacrylate), and poly(butyl acrylate). Suitable polyacetal polymers and copolymers can include, but are not limited to, for example, poly(vinylacetal), poly(vinylbutyral), poly(vinylpental), poly(vinylhexal), poly(vinylheptal), poly(vinylbutyral-co-vinylhexal), poly(vinylbutyral-co-vinylheptal), poly(vinylbutyral-co-vinyloctal), and poly(vinylbutyral-co-vinylnaphthal). Combinations of any one or more co-binder can be used. According to certain embodiments, the binder can include ethylcellulose. The ethylcellulose can have an ethoxyl content between 45 and 53%, preferably between 48 and 52%, and a solution viscosity of between 2 and 200 centipoise, for example, between 10 and 150 centipoise, as measured by a 5 wt. % solution in an 80/20 wt. % mixture of toluene and ethanol at 25° C. Mixtures of various ethylcellulose grades can be used.

The weight percent of the hydroxyalkanoic acid polyester in the total binder is the weight of the hydroxyalkanoic acid polyester divided by the total weight of the binder, that is, the weight of the co-binder plus the hydroxyalkanoic acid polyester. The hydroxyalkanoic acid polyester can be present in an amount of from 7 wt. % to 80 wt. %, for example, from 15 wt. % to 75 wt. %. At hydroxyalkanoic acid polyester contents below 7 wt. %, there is no discernible advantage over the use of other low Tg polyesters. At hydroxyalkanoic acid polyester contents at or above about 80 wt. %, further increase in print density is minimal, sticking between the dye-donor and receiver during printing can occur, and the hydroxyalkanoic acid polyester can be transferred to the back surface of the dye-donor element when stored in roll form, resulting in printing problems.

The dye-donor layer of the dye-donor element can be formed or coated on a support. The dye-donor layer composition can be dissolved in a solvent for coating purposes. The dye-donor layer can be formed or coated on the support by techniques such as, but not limited to, a gravure process, spin-coating, solvent-coating, extrusion coating, or other methods known to practitioners in the art.

The support can be formed of any material capable of withstanding the heat of thermal printing. According to various embodiments, the support can be dimensionally stable during printing. Suitable materials can include polyesters, for example, poly(ethylene terephthalate) and poly (ethylene naphthalate); polyamides; polycarbonates; glassine paper; condenser paper; cellulose esters, for example, cellulose acetate; fluorine polymers, for example, poly(vinylidene fluoride), and poly(tetrafluoroethylene-co-hexafluoropropylene); polyethers, for example, polyoxymethylene; polyacetals; polystyrenes; polyolefins, for example, polyethylene, polypropylene, and methylpentane polymers; polyimides, for example, polyimide-amides and polyether-imides; and combinations thereof. The support can have a thickness of from 1 μm to 30 μm, for example, from 3 μm to 7 μm.

According to various embodiments, a subbing layer, for example, an adhesive or tie layer, a dye-barrier layer, or a combination thereof, can be coated between the support and the dye-donor layer. The subbing layer can be one or more layers. The adhesive or tie layer can adhere the dye-donor layer to the support. Suitable adhesives are known to practitioners in the art, for example, Tyzor TBT™ from E.I. DuPont de Nemours and Company. The dye-barrier layer can include a hydrophilic polymer. The dye-barrier layer can provide improved dye transfer densities.

The dye-donor element can include a slip, or slipping, layer to reduce or prevent a print head sticking to the dye-donor element. The slip layer can be coated on a side of the support opposite the dye-donor layer. The slip layer can include a lubricating material, for example, a surface-active agent, a liquid lubricant, a solid lubricant, or mixtures thereof, with or without a polymeric binder. Suitable lubricating materials can include oils or semi-crystalline organic solids that melt below 100° C., for example, poly(vinyl stearate), beeswax, perfluorinated alkyl ester polyether, poly (caprolactone), carbowax, polyethylene homopolymer, or poly(ethylene glycol). The lubricating material can also be a silicone- or siloxane-containing polymer. Suitable polymers can include graft co-polymers, block polymers, co-polymers, and polymer blends or mixtures. Suitable polymeric binders for the slip layer can include poly(vinylalcohol-co-vinylbutyral), poly(vinylalcohol-co-vinylacetal), poly(styrene), poly(vinyl acetate), cellulose acetate butyrate, cellulose acetate, ethylcellulose, and other binders as known to practitioners in the art. The amount of lubricating material used in the slip layer is dependent, at least in part, upon the type of lubricating material, but can be in the range of from 0.001 to 2 $gm^{-2}$, although less or more lubricating material can be used as needed. If a polymeric binder is used, the lubricating material can be present in a range of 0.1 to 50 wt. %, preferably 0.5 to 40 wt. %, of the polymeric binder.

The dye-donor element can include a stick preventative agent to reduce or eliminate sticking between the dye-donor element and the receiver element during printing. The stick preventative agent can be present in any layer of the dye-donor element, so long as the stick preventative agent is capable of diffusing through the layers of the dye-donor element to the dye-donor layer, or transferring from the slip layer to the dye-donor layer, such as when the dye-donor element is stored in roll form such that the dye-donor layer is adjacent to and touches the slip layer on the backside of the dye-donor element. For example, the stick preventative agent can be present in one or more patches of the dye-donor layer, in the support, in an adhesive layer, in a dye-barrier layer, in a slip layer, or in a combination thereof. According to various embodiments, the stick preventative agent can be in the slip layer, the dye-donor layer, or both. According to various embodiments, the stick preventative agent can be in the dye-donor layer. The stick preventative agent can be in one or more colored patches of the dye-donor layer, or a combination thereof. If more than one dye patch is present in the dye-donor layer, the stick preventative agent can be present in the last patch of the dye-donor layer to be printed, typically the cyan layer. However, the dye patches can be in any order. For example, if repeating patches of cyan, magenta, and yellow are used in the dye-donor element, in that respective order, the yellow patches, as the last patches printed in each series, can include the stick preventative agent. The stick preventative agent can be a silicone- or siloxane-containing polymer. Suitable polymers can include graft co-polymers, block polymers, co-polymers, and polymer blends or mixtures. Suitable stick preventative agents are described, for example, in commonly assigned U.S. Application Publications US 2005-0059550 A1 to David G. Foster, et al., and US 2005-0059552 A1 to Teh-Ming Kung, et al.

Optionally, release agents as known to practitioners in the art can also be added to the dye-donor element, for example, to the dye-donor layer, the slip layer, or both. Suitable release agents include, for example, those described in U.S. Pat. Nos. 4,740,496 and 5,763,358.

According to various embodiments, the dye-donor layer can contain no plasticizer. Inclusion of a plasticizer in the dye-donor layer can increase dye-donor efficiency. The dye-donor layer can include plasticizers known in the art, such as those described in U.S. Pat. Nos. 5,830,824 and 5,750,465, and references disclosed therein. Suitable plasticizers can be defined as compounds having a glass transition temperature ($T_g$) less than 25° C., a melting point ($T_m$) less than 25° C., or both. Plasticizers useful for this invention can include low molecular weight plasticizers and higher molecular weight plasticizers such as oligomeric or polymeric plasticizers.

The dye-donor layer can include beads. The beads can have a particle size of from 0.5 to 20 microns, preferably from 2.0 to 15 microns. The beads can act as spacer beads under the compression force of a wound up dye-donor roll, improving raw stock keeping of the dye-donor roll by reducing the material transferred from the dye-donor layer to the backside of the dye-donor element, for example, a slipping layer, or vice versa, as measured by the change in sensitometry under accelerated aging conditions, or the appearance of unwanted dye in the laminate layer. The use of the beads can result in reduced mottle and improved image quality. The beads can be employed in any amount effective for the intended purpose. In general, good results have been obtained at a coverage of from 0.003 to 0.20 $gm^{-2}$. Beads suitable for the dye-donor layer can also be used in the slip layer.

The beads in the dye-donor layer can be crosslinked, elastomeric beads. The beads can have a glass transition temperature (Tg) of 45° C. or less, for example, 10° C. or less. The elastomeric beads can be made from an acrylic polymer or copolymer, such as butyl-, ethyl-, propyl-, hexyl-, 2-ethyl hexyl-, 2-chloroethyl-, 4-chlorobutyl- or 2-ethoxyethyl-acrylate or methacrylate; acrylic acid; methacrylic acid; hydroxyethyl acrylate; a styrenic copolymer, such as styrene-butadiene, styrene-acrylonitrile-butadiene, styrene-isoprene, or hydrogenated styrene-butadiene; or mixtures thereof. The elastomeric beads can be crosslinked with various crosslinking agents, which can be part of the elastomeric copolymer, such as but not limited to divinylbenzene; ethylene glycol diacrylate; 1,4-cyclohexylene-bis(oxyethyl)dimethacrylate; 1,4-cyclohexylene-bis(oxypropyl)diacrylate; 1,4-cyclohexylene-bis(oxypropyl) dimethacrylate; and ethylene glycol dimethacrylate. The elastomeric beads can have from 1 to 40%, for example, from 5 to 40%, by weight of a crosslinking agent.

The beads in the dye-donor layer can be hard polymeric beads. Suitable beads can include divinylbenzene beads, beads of polystyrene crosslinked with at least 20 wt. % divinylbenzene, and beads of poly(methyl methacrylate) crosslinked with at least 20 wt. % divinylbenzene, ethylene glycol dimethacrylate, 1,4-cyclohexylene-bis(oxyethyl) dimethacrylate, 1,4-cyclohexylene-bis(oxypropyl) dimethacrylate, or other crosslinking monomers known to those familiar with the art.

The dye-donor element can be a sheet of one or more colored patches or laminate, or a continuous roll or ribbon. The continuous roll or ribbon can include one patch of a monochromatic color or laminate, or can have alternating areas of different patches, for example, one or more dye patches of, for example, cyan, magenta, yellow, or black, one or more laminate patches, or a combination thereof.

The receiver element suitable for use with the dye-donor element described herein can be any receiver element as known to practitioners in the art. For example, the receiver element can include a support having thereon a dye image-receiving layer. The support can be a transparent film. Transparent supports can include cellulose derivatives, for example, a cellulose ester, cellulose triacetate, cellulose diacetate, cellulose acetate propionate, cellulose acetate butyrate; polyesters, such as poly(ethylene terephthalate), poly(ethylene naphthalate), poly(1,4-cyclohexanedimethylene terephthalate), poly(butylene terephthalate), and copolymers thereof; polyimides; polyamides; polycarbonates; polystyrene; poly(vinylalcohol-co-vinylacetal); polyolefins, such as polyethylene or polypropylene; polysulfones; polyacrylates; polyetherimides; and mixtures thereof. Opaque supports can include plain paper, coated paper, synthetic paper, photographic paper support, melt-extrusion-coated paper, and laminated paper, such as biaxially oriented support laminates. Biaxially oriented support laminates suitable for use as receivers can include those described in U.S. Pat. Nos. 5,853,965; 5,866,282; 5,874,205; 5,888,643; 5,888,681; 5,888,683; and 5,888,714. Biaxially oriented supports can include a paper base and a biaxially oriented polyolefin sheet, for example, polypropylene, laminated to one or both sides of a paper base. The support can be a reflective paper, for example, baryta-coated paper, white polyester (polyester with white pigment incorporated therein), an ivory paper, a condenser paper, or a synthetic paper, for example, DuPont Tyvek™ by E.I. DuPont de Nemours and Company, Wilmington, Del. The support can be employed at any desired thickness, for example, from 10 μm to 1000 μm. Exemplary supports for the dye image-receiving layer are disclosed in commonly assigned U.S. Pat. Nos. 5,244,861 and 5,928,990, and in EP-A-0671281. Other suitable supports as known to practitioners in the art can also be used. According to various embodiments, the support can be a composite or laminate structure comprising a base layer and one or more additional layers. The base layer can comprise more than one material, for example, a combination of one or more of a microvoided layer, a nonvoided layer, a synthetic paper, a natural paper, and a polymer.

The dye image-receiving layer of the receiver element can be, for example, a polycarbonate, a polyurethane, a polyester, poly(vinyl chloride), poly(styrene-co-acrylonitrile), poly (caprolactone), poly(vinylacetal)s for example, poly(vinylbutyral) and polyvinylheptal, poly(vinyl chloride-co-vinyl acetate), poly(ethylene-co-vinyl acetate), methacrylates including those described in U.S. Pat. No. 6,362,131, or combinations thereof. The dye image-receiving layer can be coated on the receiver element support in any amount effective for the intended purpose of receiving the dye from the dye-donor layer of the dye-donor element. For example, the dye image-receiving layer can be coated in an amount of from 1 $gm^{-2}$ to 5 $gm^{-2}$.

Additional polymeric layers can be present between the support and the dye image-receiving layer. The additional layers can provide coloring, adhesion, antistat properties, act as a dye-barrier, act as a dye mordant layer, or a combination thereof. For example, a polyolefin such as polyethylene or polypropylene can be present. White pigments such as titanium dioxide, zinc oxide, and the like can be added to the polymeric layer to provide reflectivity. A subbing layer optionally can be used over the polymeric layer in order to improve adhesion to the dye image-receiving layer. This can be called an adhesive or tie layer. Exemplary subbing layers are disclosed in U.S. Pat. Nos. 4,748,150, 4,965,238, 4,965,239, and 4,965,241. An antistatic layer as known to practitioners in the art can also be used in the receiver element. The receiver element can also include a backing layer. Suitable examples of backing layers include those disclosed in U.S. Pat. Nos. 5,011,814 and 5,096,875.

The dye image-receiving layer, or an overcoat layer thereon, can contain a release agent, for example, a silicone or fluorine based compound, as is conventional in the art. Various exemplary release agents are disclosed, for example, in U.S. Pat. Nos. 4,820,687 and 4,695,286.

The receiver element can also include stick preventative agents, as described for the dye-donor element. According to various embodiments, the receiver element and dye-donor element can include the same stick preventative agent.

The dye image-receiving layer can be formed on the support by any method known to practitioners in the art, including but not limited to printing, solution coating, dip coating, and extrusion coating. Wherein the dye image-receiving layer is extruded, the process can include (a) forming a melt comprising a thermoplastic material; (b) extruding or coextruding the melt as a single-layer film or a layer of a composite (multilayer or laminate) film; and (c) applying the extruded film to the support for the receiver element.

The dye-donor element and receiver element, when placed in superimposed relationship such that the dye-donor layer of the dye-donor element is adjacent the dye image-receiving layer of the receiver element, can form a print assembly. An image can be formed by passing the print assembly past a print head, wherein the print head is located on the side of the dye-donor element opposite the receiver element. The print head can apply heat image-wise or patch-wise to the dye-donor element, causing the dyes or laminate in the dye-donor layer to transfer to the dye image-receiving layer of the receiver element.

Thermal print heads that can be used with the print assembly are available commercially and known to practitioners in the art. Exemplary thermal print heads can include, but are not limited to, a Fujitsu Thermal Head (FTP-040 MCSOO1), a TDK Thermal Head F415 HH7-1089, a Rohm Thermal Head KE 2008-F3, a Shinko head (TH300U162P-001), and Toshiba heads (TPH162R1 and TPH207R1A).

Use of the dye-donor element including an hydroxyalkanoic acid polyester binder as described herein allows high-speed printing of the print assembly, wherein high speed printing refers to printing at a line speed of 2.0 msec per line or less, for example, 1.5 msec per line or less, 1.2 msec per line or less, 1.0 msec per line or less, or 0.5 msec per line or less. Use of an hydroxyalkanoic acid polyester in a binder can produce a defect-free image with a resultant print density greater than or equal to 2.0.

Examples are herein provided to further illustrate the invention.

EXAMPLES

Materials used in the examples include the following: Aqualon™ N50 ethylcellulose polymer from Hercules Chemical, Wilmington, Del., with an ethoxyl content of 48.0–49.5%; Ethocel™ 100 (EC100) standard industrial grade ethylcellulose, with 48.0–49.5% ethoxyl content, from Dow Chemical Company, Midland, Mich.; CAP-482-20 (CAP) cellulose acetate propionate with 2.5% acetyl, 46.0% propionyl, and 1.8% hydroxyl from Eastman Chemical Company, Kingsport, Tenn.; Butvar™ B76 poly(vinylbutyral) (PVB) from Solutia Incorporated, St. Louis, Mo., with 88% butyral, 1% acetate, and 11% hydroxyl; Paraplex™ G25 polyester sebacate ($T_m$ −20° C., $M_w$ 8000) from CP Hall Company, IL; polycaprolactone (PCL) ($T_g$ −60° C.) from Scientific Polymer Products, Ontario, N.Y., with MW=32,000, or from Aldrich, Wis., MW=65,000. Other materials are set forth in individual examples.

Example 1

Cyan Dye-Donor Elements with CAP Co-Binder

Dye-Donor Element I-1 (GC1-2354-23)

A dye-donor element was prepared by gravure coating the following layers in the order recited on a first side of a 4.5 micron poly(ethylene terephthalate) support. After coating each layer, the element was dried and wound, then unwound for coating the subsequent layer.

(1) a subbing layer of a titanium alkoxide (Tyzor TBT™ from E.I. DuPont de Nemours and Company) (0.16 $gm^{-2}$) from n-propyl acetate and n-butyl alcohol solvent mixture, and (2) a dye-donor layer containing: cyan dye #1 at 0.093 $gm^{-2}$, cyan dye #2 at 0.084 $gm^{-2}$, and cyan dye #3 at 0.21 $gm^{-2}$, wherein the cyan dyes are illustrated below; PCL (Scientific Polymer Products, NY) binder at 0.113 $gm^{-2}$; CAP co-binder at 0.113 $gm^{-2}$; and divinylbenzene beads at 0.0084 $gm^{-2}$ coated from a solvent mixture of 70 wt. % toluene, 25 wt. % methanol, and 5 wt. % cyclopentanone.

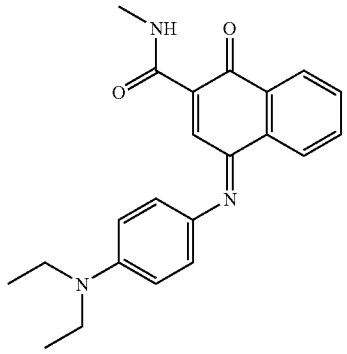

cyan dye #1

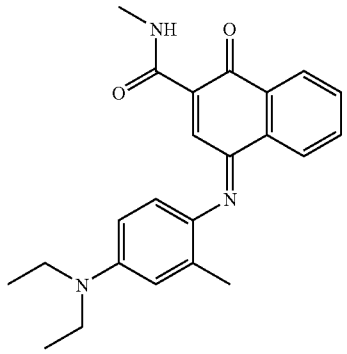

cyan dye #2

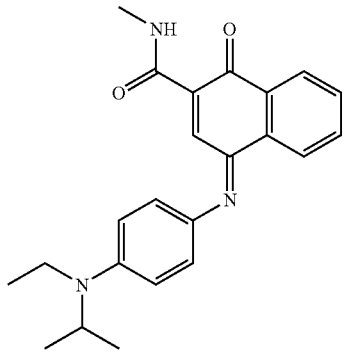

cyan dye #3

On a second side of the support, a slipping layer was prepared by coating the following layers in the order recited:

(1) a subbing layer of a titanium alkoxide (Tyzor TBT™) (0.16 $gm^{-2}$) from n-propyl acetate and n-butyl alcohol solvent mixture, and (2) a slipping layer containing an ethene polymer of Polywax™ 400 (0.02 $gm^{-2}$), a poly(alpha-olefin) of Vybar™ 103 (0.02 $gm^{-2}$), and a maleic anhydride copolymer of Ceramer™ 1608 (0.02 $gm^{-2}$), all from Baker-Petrolite Polymers, Sugar Land, Tex., and a poly(vinylacetal) binder (0.41 $gm^{-2}$) (Sekisui KS-1) coated from a solvent mixture of 75 wt. % toluene, 20 wt. % methanol, and 5 wt. % cyclopentanone.

Receiver R-1

Receiver R-1 of the composition shown below was prepared, having an overall thickness of about 220 μm and a thermal dye-receiving layer thickness of about 3 μm. R-1 was prepared by solvent coating the subbing layer and dye-receiving layer onto the prepared paper support.

| R-1 |
|---|
| 4–8 μm divinylbenzene beads and solvent coated cross-linked polyol dye-receiving layer |
| Subbing layer |
| Microvoided composite film OPPalyte ™ 350 K18 (ExxonMobil, NY) |
| Pigmented polyethylene |
| Cellulose Paper |
| Polyethylene |
| Polypropylene film |

Dye-Donor Elements I-2, I-3 and I-4

Dye-donor elements I-2, I-3, and I-4 were prepared the same as dye-donor element I-1, except that the weight ratio of PCL binder to CAP co-binder in the dye-donor layer was varied by varying the amounts of PCL and CAP, as listed in Table 1.

Comparative Element C-1

Comparative element C-1 was prepared the same as dye-donor element I-1, except that CAP was used as the binder in an amount of 0.225 $gm^{-2}$. No PCL was added.

Procedure

An 11-step patch image of optical density (OD) ranging from $D_{min}$ (OD<0.2) to $D_{max}$ (OD>2.0) was printed for dye-donor/receiver sensitometry and sticking performance evaluation. When printed using 0.52 msec per line and a resistive head voltage of 25.4 V, this is equivalent to equal energy increments ranging from a print energy of 0 $Jcm^{-2}$ to a print energy of 0.653 $Jcm^{-2}$. When printed using 0.52 msec per line and a resistive head voltage of 32 V, this is equivalent to equal energy increments ranging from a print energy of 0 $Jcm^{-2}$ to a print energy of 1.037 $Jcm^{-2}$. Printing was done manually as described below.

The dye side of each dye-donor element was placed in contact with the dye image-receiving layer of the receiver element R-1 of the same width to form a print assembly. The print assembly was fastened to a stepper motor driven pulling device. The imaging electronics were activated, causing the pulling device to draw the print assembly between a print head and a roller at a rate of about 163 mm/sec. The printing line time was 0.52 msec per line. The voltage supplied to the resistive print head was constant for a given print. Prints were made either at 25.4 volts or at 32 volts, corresponding to maximum print energies of 0.653 and 1.037 $Jcm^{-2}$, respectively. Print conditions are indicated in each Table. After each print, the dye-donor element and receiver element were separated manually and the Status A red reflection density of each printed step of the 11-step patch image on the receiver was measured using an X-Rite Transmission/Reflection Densitometer (model 820; X-Rite Incorporated). The values of the red density at a print energy of 1.037 $Jcm^{-2}$ obtained when printing each dye-donor element to receiver R-1 are reported in Table 1.

TABLE 1

RED DENSITY (CAP co-binder)

| Element | Binder/Co-binder Ratio (%) | PCL ($gm^{-2}$) | CAP ($gm^{-2}$) | Red Density 1.037 $Jcm^{-2}$ |
|---|---|---|---|---|
| I-1 | PCL/CAP 50/50 | 0.113 | 0.113 | 2.08 |
| I-2 | PCL/CAP 29/71 | 0.065 | 0.160 | 2.14 |
| I-3 | PCL/CAP 17/83 | 0.038 | 0.187 | 2.06 |
| I-4 | PCL/CAP 7/93 | 0.017 | 0.225 | 1.96 |
| C-1 | PCL/CAP 0/100 (pure CAP) | 0 | 0.225 | 1.86 |

The above results show that when the dye binder includes an hydroxyalkanoic acid polyester, such as PCL, with a co-binder, such as CAP, higher optical print densities can be obtained than when the binder consists solely of the co-binder material. The increased densities achieved by the inventive examples can be a critical advantage when printing at faster speeds.

Example 2

Magenta Dye-Donor Elements

Dye-Donor Element I-5

A dye-donor element was prepared the same as dye-donor element I-1 except that the dye-donor layer contained materials in the following amounts: Magenta dye #1 at 0.0700 $gm^{-2}$, Magenta dye #2 at 0.0642 $gm^{-2}$, and Magenta dye #3 at 0.1462 $gm^{-2}$, wherein the dyes are illustrated below; PCL (Scientific Polymer Products, NY) binder at 0.027 $gm^{-2}$; Aqualon™ N50 co-binder at 0.270 $gm^{-2}$; and divinyl benzene beads at 0.0054 $gm^{-2}$ coated from a solvent mixture of 70 wt. % toluene, 25 wt. % methanol, and 5 wt. % cyclopentanone.

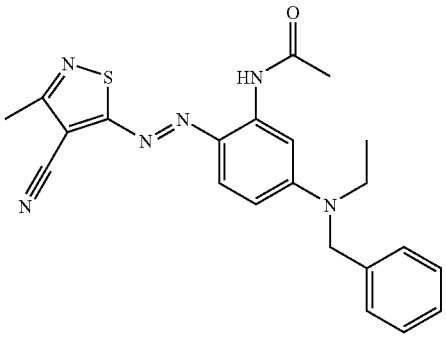

Magenta dye #1

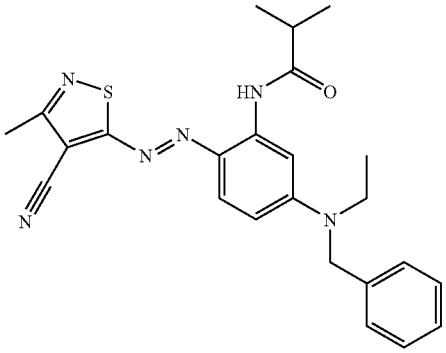

Magenta dye #2

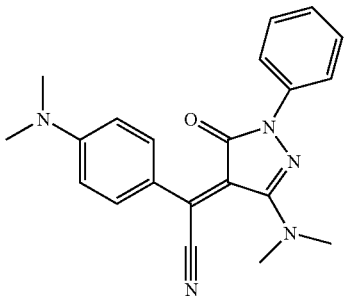

Magenta dye #3

Dye-Donor Elements I-6, I-7 and Comparative Element C-2

Dye-donor elements I-6 and I-7, and comparative element C-2, were prepared the same as dye-donor element I-5, except that the weight ratio of PCL binder to Aqualon™ N50 ("N50") co-binder in the dye-donor layer was varied as shown in Table 2.

Procedure

Dye-donor elements I-5 through I-7 and Control element C-2 were printed to receiver R-1 as described for Example 1. The print densities were measured in the same manner as in Example 1, except that the Status A green reflection density of each printed step of the 11-step patch image was measured using an X-Rite Transmission/Reflection Densitometer (model 820; X-Rite Incorporated). The values of the green density at the two different print energies of 0.653 and 1.037 $Jcm^{-2}$ obtained when printing each dye-donor element to receiver R-1 are reported in Table 2.

TABLE 2

GREEN DENSITY

| Element | Binder/Co-binder Ratio (%) | PCL ($gm^{-2}$) | N50 ($gm^{-2}$) | Green Density at 1.037 $Jcm^{-2}$ | Green Density at 0.653 $Jcm^{-2}$ |
|---|---|---|---|---|---|
| I-5 | PCL/N50 9/91 | 0.027 | 0.27 | 2.39 | 1.13 |
| I-6 | PCL/N50 13/87 | 0.038 | 0.259 | 2.39 | 1.14 |
| I-7 | PCL/N50 17/83 | 0.049 | 0.247 | 2.46 | 1.19 |
| C-2 | PCL/N50 0/100 (pure N50) | 0 | 0.297 | 2.35 | 1.03 |

The above results show that when the dye binder includes an hydroxyalkanoic acid polyester, such as PCL (polycaprolactone), with a co-binder, such as N50, higher optical print densities can be obtained than when the binder consists solely of the co-binder. The increased densities achieved by the inventive examples can be a critical advantage when printing at faster speeds.

Example 3

Cyan Dye-Donor Elements with PVB Co-Binder

Dye-donor elements I-8 through I-11 and comparative elements C-3 through C-6 were prepared the same as dye-donor element I-1, except that the coated dye-donor elements were not wound after the dye patch was applied, the CAP co-binder was replaced by PVB co-binder, and the PCL binder was obtained from Aldrich. The ratio of binder to co-binder for each element is listed in Table 3, as well as the amounts of binder and co-binder.

Dye-donor elements I-8 through I-11 and comparative elements C-3 through C-6 were interleaved with paper after coating and drying the dye layer, and prior to rolling up the dye-donor element, to ensure that the dye layer did not contact the slipping layer.

Procedure

Dye-donor elements I-8 through I-11 and comparative elements C-3 through C-6 were printed to receiver R-1 in the same manner as in Example 1. The values of the red density at a print energy of 0.653 $Jcm^{-2}$ obtained when printing each dye-donor element to receiver R-1 are reported in Table 3. The printed images were also examined for dye-donor/receiver sticking. The examination was done by visual examination of the receiver elements. Dye-donor/receiver sticking was identified by the presence of defects on the printed receiver element, for example, the presence of unwanted dye transferred to the receiver element, the presence of dye layer stuck to the receiver, and uneven and randomized spots across the receiver element. The number of steps in the 11-step patch image that showed sticking to receiver R-1 were recorded for each sample and are shown in Table 3.

TABLE 3

RED DENSITY (PVB-B76 co-binder)

| Element | Binder/Co-binder Ratio (%)) | PCL ($gm^{-2}$) | PVB ($gm^{-2}$) | Red Density | # steps stuck |
|---|---|---|---|---|---|
| I-8 | PCL/PVB 70/30 | 0.158 | 0.067 | 0.94 | 0 |
| I-9 | PCL/PVB 50/50 | 0.113 | 0.113 | 0.90 | 0 |
| I-10 | PCL/PVB 40/60 | 0.090 | 0.135 | 0.93 | 0 |

TABLE 3-continued

RED DENSITY (PVB-B76 co-binder)

| Element | Binder/Co-binder Ratio (%)) | PCL ($gm^{-2}$) | PVB ($gm^{-2}$) | Red Density | # steps stuck |
|---|---|---|---|---|---|
| I-11 | PCL/PVB 30/70 | 0.067 | 0.158 | 0.91 | 0 |
| C-3 | PCL/PVB 100/0 (pure PCL) | 0.225 | 0.0 | 1.02 | 2 |
| C-4 | PCL/PVB 90/10 | 0.203 | 0.023 | 1.0 | 2 |
| C-5 | PCL/PVB 80/20 | 0.180 | 0.045 | 0.94 | 2 |
| C-6 | PCL/PVB 0/100 (pure PVB) | 0.0 | 0.225 | 0.82 | 0 |

The results from Tables 1, 2, and 3 show that optimal results are obtained when PCL is present from about 7 wt. % to less than 80 wt. % relative to the co-binder. Although high print densities can be obtained when the amount of PCL is equal to or greater than 80 wt. %, sticking between the dye-donor layer and dye receiver layer occurs during printing (see C-4, C-5). When the amount of PCL is present at less than about 7 wt. %, no improvement in print density is obtained. The increased densities achieved by the inventive examples can be a critical advantage when printing at faster speeds.

Example 4

Stability of Cyan Dye-Donor Elements

Dye-Donor Element I-12

Dye-donor elements I-12, I-13, and I-14 were prepared the same as dye-donor elements I-4, I-3, and I-2, respectively, except that CAP was replaced by EC100 co-binder. The ratio of PCL binder to EC100 co-binder in the dye-donor layer, and the amounts of binder and co-binder, are listed in Table 4.

Comparative Elements C-7 Through C-9

Comparative elements C-7 through C-9 were prepared the same as dye-donor elements I-12 through I-14, respectively, except that the PCL binder was replaced by a polyester, Paraplex™ G25. The ratio of binder to co-binder and the amounts of each are listed in Table 4.

Procedure

Approximately 25 feet of coating from each of the dye-donor elements I-12 through I-14 and comparative elements C-7 through C-9 were wound onto a plastic core with the slipping layer side wound out, sealed into an aluminum foil-lined, heat sealed bag, and incubated for 3 days at 60° C. Approximately 15 feet of the dye-donor element was unwound and the dye side was examined with an optical microscope at 500× magnification using transmitted light to evaluate the uniformity after dye-donor spool incubation. Table 4 lists the microscopic appearance of these dye-donor elements after incubation.

TABLE 4

CYAN DYE LAYER KEEPING

| Element | Binder/Co-binder Ratio (%) | PCL ($gm^{-2}$) | EC 100 ($gm^{-2}$) | G25 ($gm^{-2}$) | Dye-donor layer appearance |
|---|---|---|---|---|---|
| I-12 | PCL/EC100 7/93 | 0.017 | 0.225 | 0 | No change |
| I-13 | PCL/EC100 17/83 | 0.038 | 0.187 | 0 | Few very light dye spots |
| I-14 | PCL/EC100 29/71 | 0.065 | 0.160 | 0 | Few very light dye spots |
| C-7 | G25/EC100 7/93 | 0 | 0.225 | 0.017 | No change |
| C-8 | G25/EC100 17/83 | 0 | 0.187 | 0.038 | Dense dye spots |
| C-9 | G25/EC100 29/71 | 0 | 0.160 | 0.065 | Large dense dye spots |

The above results show that when the dye binder includes an hydroxyalkanoic acid polyester, such as PCL, with a co-binder, such as ethylcellulose, the keeping stability of the dye-donor layer remains acceptable, whereas when the binder includes a low Tg polyester such as Paraplex G25 with the co-binder, the keeping stability of the dye-donor layer is not acceptable. The dye spots that appear in the dye-donor upon keeping will result in changes in printing density over time.

Example 5

Cyan Dye-Donor Element with 100% PCL

Comparative element C-10 was prepared the same as dye-donor element C-1, except that PCL binder was used in place of CAP. The PCL was coated at 0.225 $gm^{-2}$. Both coating elements C-1 and C-10 were prepared in the same manner as I-1. The slipping layer was coated on the backside after the dye side was coated. The dye side and slip side coatings were dried in-line at 77° C. (170° F.) during their respective solvent gravure coating operations, and wound in a roll with the slipping layer side wound out.

Control coating element C-10 was printed in a manner identical to the method used for Example 1. During printing of dye-donor comparative element C-10, the dye-donor patch transferred cyan dye into the non-image portions of the print where no power was applied to the print head. There was no dye transferred in the non-image portions of the print using comparative element C-1 or inventive elements or I-1 through I-4. Transfer of the PCL to the slipping layer side of the C-10 dye-donor element during the coating and winding operations caused the dye-donor element to fold over and roll up during printing, resulting in non-uniform printing. This problem with transport during printing did not occur on any other wound comparative element C-1, C-2, or C-7 through C-9, or wound inventive elements I-1 through I-7 or I-12 through I-14.

The invention has been described in detail with particular reference to certain preferred embodiments thereof, but it will be understood that variations and modifications can be effected within the spirit and scope of the invention.

The invention claimed is:

1. A thermal transfer dye-donor element comprising a thermal transfer dye-donor layer and a substrate, wherein the thermal transfer dye-donor layer comprises a transferable dye and a binder, wherein the binder comprises an hydroxyalkanoic acid polyester having a Tg less than 25° C. and a co-binder that is not a polyester, wherein the hydroxyalkanoic acid polyester has the following formula:

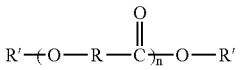

wherein each R is independently selected from an alkyl or alkylene oxide group of from 1 to 12 carbon atoms, wherein each alkyl group can be linear, branched, or cyclic; each R' is independently selected from a hydrogen atom or an alkyl group or substituted alkyl group of from 1 to 24 carbon atoms; wherein R or R' can be substituted; and wherein n is an integer selected so that the hydroxyalkanoic acid polyester has a polystyrene equivalent weight average molecular weight of from about 10,000 to about 500,000 wherein the binder comprises hydroxyalkanoic acid polyester in an amount of from 7% to less than 80% of the total amount of binder.

2. The element of claim 1, wherein the co-binder is a cellulose ester, a cellulose ether, a cellulose nitrate, a hydroxyalkylcellulose, an acetal, an acrylate, or a styrenic polymer or copolymer or a derivative thereof, or a combination thereof.

3. The element of claim 1, wherein the co-binder is a cellulose acetate propionate, cellulose acetate butyrate, ethylcellulose, hydroxypropylcellulose, poly(vinylbutyral), or a combination thereof.

4. The element of claim 1, wherein the hydroxyalkanoic acid polyester is polycaprolactone.

5. The element of claim 1, wherein hydroxyalkanoic acid polyester has a polystyrene equivalent weight average molecular weight of from about 14,000 to about 200,000.

6. print assembly comprising the dye-donor element of claim 1 and a receiver, wherein the receiver comprises a support and a dye-receiving layer on the support.

7. The print assembly of claim 6, wherein the dye-receiving layer is extruded.

8. A method of printing using the assembly of claim 6, comprising:

placing the dye-donor element and receiver in superposed relationship such that the dye-donor layer is adjacent the dye-receiving layer; and applying energy to the dye-donor element on a side of the support opposite the dye-donor layer.

9. The method of claim 8, wherein the energy is applied at a print speed of 2 msec per line or less.

* * * * *